US006237620B1

(12) United States Patent
Ferguson

(10) Patent No.: US 6,237,620 B1
(45) Date of Patent: May 29, 2001

(54) CONDUIT FOR PRESSURIZING PLUMBING SYSTEMS AND SUPPLYING ZANTIFREE PLUMBING SYSTEMS

(76) Inventor: Patrick B. Ferguson, 3438 Bellvue Rd., Toledo, OH (US) 43606

( * ) Notice: Subject to any disclaimer, the term of this patent is extended or adjusted under 35 U.S.C. 154(b) by 0 days.

(21) Appl. No.: 09/455,346

(22) Filed: Dec. 6, 1999

(51) Int. Cl.[7] ..... E03B 7/12; E03C 1/02

(52) U.S. Cl. ..... 137/209; 137/240; 137/334; 137/899; 138/34

(58) Field of Search ..... 137/203, 205, 137/209, 240, 899, 301; 138/32, 34; 141/65, 66; 134/95.1, 99.1, 99.2, 166 C, 171; 237/80

(56) References Cited

U.S. PATENT DOCUMENTS 3,384,123 * 5/1968 Saddison ..... 138/34
3,845,779 * 11/1974 Greene, Jr. ..... 137/209
3,929,154 * 12/1975 Goodwin ..... 137/899
4,246,926 * 1/1981 Morello ..... 137/209
4,286,617 * 9/1981 Bedient ..... 137/334
4,298,021 * 11/1981 Bozeman ..... 137/334
4,531,538 * 7/1985 Sandt et al. ..... 137/334
4,809,732 * 3/1989 Buehler ..... 137/209
5,293,904 * 3/1994 Wood ..... 138/35
5,433,246 * 7/1995 Horton ..... 137/209
5,488,968 * 2/1996 Price et al. ..... 138/34
5,538,031 * 7/1996 Brence et al. ..... 137/334
5,676,182 * 10/1997 McMullen, Jr. et al. ..... 137/240

* cited by examiner

*Primary Examiner*—George L. Walton
(74) *Attorney, Agent, or Firm*—Paul F. Stutz

(57) ABSTRACT

Novel combination conduit and reservoir connector adapted for connecting to and/introducing compressed air to purge water from a plumbing system and to then introduce anti-freeze into said plumbing system in a simple and expeditious manner.

6 Claims, 1 Drawing Sheet

CONDUIT FOR PRESSURIZING PLUMBING SYSTEMS AND SUPPLYING ZANTIFREE PLUMBING SYSTEMS

The present invention relates generally to the field of tools or implements. More particularly the invention relates to a tool/implement, which is multi-functional in that it serves to introduce a gas, for example, air into a plumbing system, and secondly thereafter introducing liquid antifreeze into a closed plumbing system.

Even more particularly, the present invention relates to a novel tool, which assists in two ways in the winterizing of the plumbing system for a recreational vehicle, boat/yacht, house, cottage, or other structure which is possessed of an interior plumbing system which is desirably shut down during the winter months, when the temperature falls below the freezing point 32° F. The tool of this invention can be easily connected to a compressor outlet and easily connected to the appropriate plumbing fixture inlet of any of the systems referred to hereinabove.

In the latitudes where the winter seasons or winter months bring below freezing temperatures, it is incumbent upon the owner or occupant of certain/particular structures, featuring indoor plumbing, to take steps to prevent the freezing of the liquid or fluid within the plumbing systems. Structures of this kind include recreational vehicles, boats/yachts, as well as residences, particularly cottages in a remote area and nominally not in use during the winter months.

Many folks own cottages or other structures, eg. lodges, located in remote regions such as by a lake for fishing or a wilderness area for hunting, which are frequently occupied during the summer months, including spring and fall. With the onset of winter, these cottages, lodges, resort, etc., are necessarily winterized in order to prevent damage to the plumbing by the onset of freezing weather, yielding frozen pipes, as well as burst pipes due to the expansion accompanying the water turning to solid ice after sufficient exposure to ambient temperature below freezing. Similarly, recreational vehicles such as trailers, both of the kind that are pulled by motorized vehicle, or self-contained motor homes are stored during the winter months and used only in the times of clement moderate weather encountered in the spring, summer or in the fall of the normal seasons and same is true of boats. Many feature interior plumbing systems for conveying water from a source to the various sink, lavatories, bathrooms, and kitchen regions necessarily and desirably featuring a supply of water, both hot and cold, for the convenience of the person or persons occupying the particular unit in the summer months.

In addition to boats, yachts, and land traversing recreational vehicles such as mobile homes/trailers etc., which are generally known to be stored in the off season; there is also the non movable type of dwelling which are built in a remote region as perhaps as around a lake, forest, or a stream for use for a recreational purpose principally in the spring, summer, and fall. The same structures, including cottages, lodges, etc., are unoccupied during the winter months and should therefore be winterized to avoid the formation of ice in the piping, whether it is metal or plastic and therefore subject to damage if the water inside the pipe freezes, with accompanying expansion. Such expansion almost always results in a fracture or breaking of the pipe, or possibly the valve, or whatever part of the plumbing, to the financial detriment of the owner who must underwrite rather expensive replacement of the broken pipes, valves, or whatever is part of the plumbing systems. This expense can be considerable when it is realized that the pipes constituting the plumbing system for conveyance of water throughout the vehicle, boat/yacht, cottage, or lodge may proceed in relatively inaccessible regions; which may require removal of a structural component of the mobile home, boat/yacht, cottage, or lodge, in order to provide access to the freeze damaged length of pipe or the particular fitting adversely affected by the freezing temperature in the winter months.

Now the problem or phenomenon of the freezing pipe or plumbing in the general plumbing system within the mobile home, boat/yacht, cottage, or lodges is generally well know.

It has been known that one expedient which may be used to avoid the problem is to bleed the water from the plumbing system entirely and replace it with a potable liquid formulated to remain liquid over a range of temperatures associated with the particular latitude or the degree of severity of the winter associated with the particular geographic location. Commercial liquids have been formulated and are available to the public at large. The containers bear labels which are informative as to the temperature conditions which maybe used without freezing. Generally the liquids are color-coded a pink color for identification purposes.

In some cases a simple opening of the faucet and allowing the water to drain by gravity is used and antifreeze introduced into the plumbing system, by any variety of techniques. Many of these drain and replace techniques however provide inadequate protection, since all of the water is not withdrawn from the system due to the positioning of the piping and in the particular system under consideration.

I am aware that additionally a number of patents have issued disclosing variety of systems and techniques for draining water from the system and replacing it with a liquid antifreeze to avoid the fractured, broken, or ruptured piping problem due to freezing of the water at the temperature encountered at that particular geographic location.

One such patent is U. S. Pat. 4,286,617, dated Sep. 1, 1981, to Marvin Bedient. Another such technique is disclosed U. S. Pat. No. 5,488,968 issued Feb. 6, 1996 to John Price and Michael Way. Another system is disclosed in U.S. Pat. No. 5,507,310, dated Apr. 16, 1996, and issued to David Sordello and Carl Engstrom. Yet another winterizing system is disclosed in U.S. Pat. No. 5,538,031, dated Jul. 23, 1996, to Shelby and Diana Brence. Another apparatus/method for winterizing seasonal dwellings is disclosed in the U. S. Pat. No. 5,676,182 issued Oct. 14, 1997 to George McMullen and David Watson.

A careful detailed examination of each of the aforesaid patents reveals the disclosure of a number and variety of plumbing systems requiring winterization, that is by removal of water and substitution of an antifreeze liquid which will not freeze at the temperatures water freezes, namely 32° F. and below. The examination also reveals that the systems, apparatus, equipment, and techniques described in said patents are cumbersome, are complicated, and utterly fail to disclose, suggest, or teach the novel multifunctional tool of this invention. By multifunctional, I mean just that; that the tool serves in the rapid removal of water from the plumbing system and it also serves in the introduction of replacement fluid (which is an antifreeze), into the system whereby the pipes will not burst due to expanding ice as the temperature drops.

In the light of the foregoing, it may be stated as a principle object of the principle invention to provide a novel, simple, uncomplicated, multifunctional, and a unitary device which is useful in the winterizing treatment of the plumbing, constituting the water system of a variety of homes, vehicles, mobile homes, boats, yachts, and etc.

It is another object of the present invention to provide such a simplified and inexpensive device, which is capable of use for the intended purpose by an individual with little or no assistance.

It is still another object of the present invention to provide such a device, which is of such unique design as utilizes already existing components which are readily available at low cost from many sources.

It is another object of the present invention to provide such a device, as referred to and described herein, which is extremely lightweight, whereby it may be easily manipulated and used by the one seeking to accomplish the purposes for which the tool is intended.

The foregoing, and as well as other objects of the present invention, will become apparent to those skilled in the art taken in conjunction with the annexed sheet of drawings, on which there is presented, for purposes of illustration only, a single embodiment of the present invention.

IN THE DRAWINGS

Figures 1, 2:
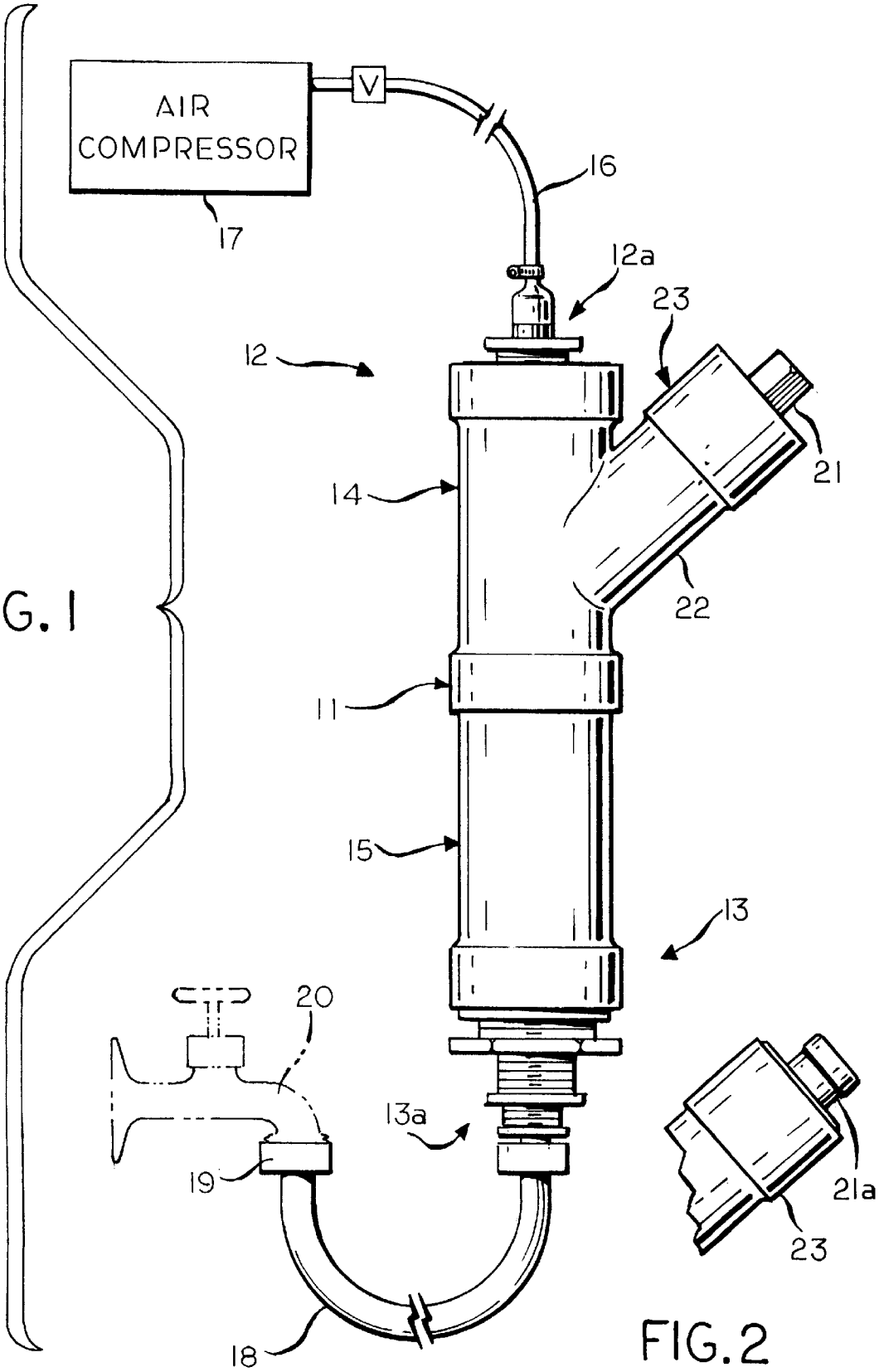
FIG. 1 is a side elevation view of the novel unit of the present invention.
FIG. 2 is a partial side elevation view of an alternate stricture of the side entry mechanism, shown in FIG. 1.

In it's simplest embodiment, the present invention comprises a pair of commercially available, over the counter, fittings, manufactured of a plastic, such as PVC or the like, axially and sealingly connected together and the uppermost of which having a side entry, with an appropriate closure, for introduction of antifreeze and the upper end being modified for connection to a conventional air compressor and the lower end being modified for connection to a faucet or spigot, as shown.

Referring now more specifically to the drawings, there is disclosed in FIG. 1 the device 11 of the present invention, having an inlet end 12 and an outlet end 13. The inlet end 12 is defined by the upper terminal end of a length of 3½ inch diameter PVC (polyvinyl chloride) pipe 14 measuring about 10 inches in length. Both ends of the length of pipe have matching interior or exterior threads formed therein for purposes of joinder. The outlet end 13 of the device 11 is defined by the lower end of a similar length of a 3½ inch inside diameter PVC (polyvinyl chloride) pipe 15; likewise having threaded interior ends not shown. The two lengths of 3½ inch diameter pipe are threadingly connected, as shown in the drawing, to define a tubular vessel, measuring about 3½ inches in diameter and approximately 20 inches in length, adapted to contain about 64 fluid ounces of liquid. The tipper end 12 is fitted with a series of axially threaded reducers 12*a* or reducing fittings terminating in the end one adapted to connect with a hose 16 either threadingly or as by a hose-clamp connection as shown. This hose of indeterminate length is used to connect the unit 11 to a source of air pressure, such as any available and suitable air compressor, having a capacity ranging from 2 PSI to 40 PSI as driven by a electric motor ranging from 2 horse power to 5 horse power. Air compressors are generally rated in cubic inches or cubic feet output per unit of time and a suitable such unit is marketed by Sears, Craftman, as model #919.162080.

The lower threaded end of the pipe 15 is threadingly engaged via one or more reducing units 13*a* in actual threaded engagement yielding ultimately through a series of such reducer fittings to a size measuring ½ or ⅝inches for connection to a conventional hose 18 leading to a female hose connector 19, which will threadingly engage, for example, the exterior faucet 20 of a dwelling or a mobile home.

In accordance with a significant feature of the present invention, uppermost section of pipe 14 features an angular inlet 22 defined by the integral Y 22 and 23 whose outer end or terminus is threaded to receive a cap or plug 21. This feature of construction allows and provides the dual functionality of the device or tool 11 of the present invention, in a manner as will be described hereinafter in connection with the operation and use of the tool for the purpose, for which it has the greatest utility; that is in the winterization of plumbing systems for the variety of vehicles and structures as described herein.

In earlier days, winterization of the plumbing systems, as described herein, was accomplished primarily by opening all valves and outlets, and drains in the hope that water within the plumbing or tubing making tip the plumbing would drain from the system, thereby avoiding the freezing of water within the system with ultimate expansion, fracture or damage to the plumbing itself. It was often discovered however, that merely allowing gravity to cause downward movement of the water in the system at the lowest point hopefully a drain or faucet at the lower level, did not always work; due to the fact that the plumbing was so convoluted and complicated that there were regions of the plumbing that retained collected water. For example, a long length of pipe might have a sag in it, which would retain water. In another case scenario the plumbing would be such as to define a U configuration providing a trap region, from which water could not flow. As a consequence of this and other scenarios, water was retained in the plumbing system and became frozen as the temperature dropped, resulting in plumbing fracture or pipe fracture in the system, adding to the yearly maintenance charge, for example having to replace the plumbing, frequently at considerable expense.

It then became a practice in the art to introduce air, as by a source of compressed air, through the system, and to add a liquid antifreeze, which would not freeze at the ambient conjunction, but which was potable and uninjurious to the user of the system the following spring after allowing the usually pink colored liquid antifreeze to drain, before connecting the plumbing system up to a source of water, following which the system is flushed, and ultimately even the residual antifreeze, albeit potable, is eliminated from the system.

It has become common practice to employ both compressed air (or a flushing with air) followed by addition of the liquid antifreeze, having a compositional makeup, yielding a freezing point, adequate to the latitude in which the system is located.

As indicated, the patents enumerated hereinabove, and discussed briefly disclose a number of systems, techniques and connections for accomplishing for a winterization of one or more types of the plumbing systems in question.

In the use of the tool of the present invention, one first connects one end of the tool using flexible tube 18 by connecting the fitting 19 to the lower most faucet valve or outlet 20 of the plumbing system. Next the fitting 12*a* at the upper end 12 is connected to a conveniently located portable and removable compressor 17. Then a person located inside the structure in which the plumbing system to be winterize is located, opens a faucet valve in the upper regions of the plumbing system and the portable compressor 17 is actuated to direct compressed air through the conduit 11 defined by the two axially connected 3½ inch polyvinyl chloride pipe sections 14 & 15. The compressed air proceeds through the conduit 11 then out the bottom of the unit through the hose 18 through the faucets 20 pushing water in front of it, causing it to exit the faucet opened valve in the upper reaches of the plumbing system, defined by the array of plumbing/ piping leading to the various service areas, such as the kitchen or galley, and bathrooms/lavatories or heads, etc.

This is repeated again and again by closing the faucet valve, just previously opened, and opening another faucet valve and reintroducing the compressed air into the system, thereby expelling the water from that portion of the facility piping connected to said valve. There is admittedly a certain amount of experience that is drawn to bear upon the faucet opening and closing of the valves and introducing the pressure sequentially as various faucet valves are open in order to accomplish expulsion of substantially all of the water within the plumbing defining the system.

When this phase is completed, that is the water expulsion phase is accomplished, one then proceeds to the next phase, which is the introduction of the liquid antifreeze into the system. This can be accomplished most conveniently with the tool of the present invention. One simply removes the plug 21 from the end of the angle or Y connection 22 formed in the upper 3½ inch diameter length polyvinyl chloride tubing introduces the antifreeze into the system by pouring an amount of the liquid antifreeze sufficient to fill the volume defined by the combined volumes of the lengths of the PVC tubing. The plug 21 is then threadingly reinserted to close the system and the compressed air is employed as before, only this time, it pushes the liquid antifreeze (usually color coded pink) out the lower end 13 to the hose 18 and through the open faucet valve 20; while at the same time, opening one or more of the faucets inside the building, or mobile home, or the like; until pink liquid exits that particular faucet valve. When this stops, one shuts that faucet valve and proceeds to open another faucet and so on and so on. Here again a little experience is brought to bear in the selection and sequence of the opening of faucets and the sequence introducing the liquid and the compressed air via the unit 11 of this invention. This process is repeated until all the faucets or outlets show pink liquid exiting when opened, when the system is under pressure, as via the compressed air through the inlet 12 forcing pink liquid out the outlet 13 of the tool 11. The tool 11 is intended to complete the purging of water from a water system of an RV, a boat, a cottage or a summer home, and then to introduce a non-toxic antifreeze, so as to protect the pipes from freezing during winter storage. The tool 11 is unique in that it is a relatively small, light weight, hand-held portable tool that easily attaches to any faucet in the home or RV. This along with the utilization of any available portable compressor, permits the user to easily and completely purge water for the household, RV or boat water system consisting of the pipes making up the plumbing system and to introduce anti-freeze as described.

It goes without saying, that the antifreeze liquid can be replenished, by simply removing the plug 21 and introducing another quantity of the liquid antifreeze, replacing the plug unit 21 and starting the compressor 17.

It will be appreciated that the compressor may be left running at all time, with the valve in the line 16 controlling, commencing, or terminating the introduction of the compressed air into the tool 11, for either purposes of exhausting water in the plumbing system or introducing the antifreeze liquid in the system, via the tool 11 as described earlier herein.

In accordance with an alternative embodiment of the present invention; rather than the plug 21 in the side angled inlet or Y passage way 22; I may choose to employ a pressure relief cap 21*a*, as shown in FIG.2. This cap is provided with a preset maximum pressure value that if exceeded, opens the unit to relieve the pressure to the atmosphere, so that is not built up to a greater value in than set, which would then otherwise damage the unit, the tool, 11 or the plumbing itself in the RV, cottage or boat or the like. These pressure or safety caps also serve to prevent pressure built-up to a dangerous degree, such as would cause rupture or fracture of the tubing components, which could possibly lead to injury of the user or person in close proximity to the unit. The pressure cap units can be purchased, for this purpose, from a variety of available sources, for engagement to the vessel being fitted and intermediate reducing or reducer members can be used to adapt to the particular available unit through the side opening, also alternatively occupied by the plug.

The advantages of the tool device of the present invention are apparent from the foregoing description of the operation of the unit. Thus the unit is quite multifunctional in that it can be used to distribute/introduce pressure from a compressor to the system under consideration and, the same unit, can be used to introduce the liquid antifreeze to the plumbing system, constituting the unit under consideration. This tool is intended to be used as a portable tool, and does not need to be incorporated as a permanent part of the facilities water system, albeit a residential home, an RV or a boat.

In the forgoing description, I have described the 3½ inch diameter fitting as formed of PVC (which is an abbreviation for polyvinyl chloride) and certainly, such fittings are readily available to a variety of sources including most hardware stores, building supplies, etc./as well as the larger stores such as Meijers, Walmart, etc. The aforesaid description, also manifest the ready availability and as well describes, the manner in which relatively available parts, including the PVC diameter pipe, can be obtained and put together in a workable fashion, as to yield the tool device 11 of the present invention having such multifunctional utility.

It will be apparent from this forgoing description, that other pipe fitting sizes maybe used with expediency. It is further obvious that rather than the side angle entry 22 in the top most fitting 14; one may well an actual Y type fitting since it will perform in exactly the same manner or one may use a T fitting in place of the side entry or the Y as the top fitting.

It is also envisioned that one may use a modified structure, by employing one or straighter nipple members connected threadingly together to extend the length of the ultimate device and, of course, increase the volume capacity for additional liquid antifreeze. Generally speaking, the fittings may be selected from fittings made of plastic substances other than PVC such as polycarbonate as well as other thermoplastic and thermosetting resins. As a specific example of an extremely strong material one may select fittings molded from a material known as ABS, which is a tripolymer formed of acrylonitrile, butadiene and styrene. Actually the selection of the particular plastic copolymer or multi-polymer may be any of those described if cost is not a factor.

It is beyond the scope of purpose of this specification and description of the manner of using the tool of this invention to elaborate on specific sequence of steps in the introduction of the liquid antifreeze into the plumbing system, since a certain amount of trial and error will be necessary to achieve the greatest amount of introduction of the liquid antifreeze into the interior of the piping of the system. Furthermore, it is not deemed necessary to go into detailed description as to the choice and sizing of the reducers at either the lower outlet end or the upper inlet end, since a wide variety of obvious possibilities exist.

It should be noted with emphasis that the conduit tool of the present invention enhances and expedites the accomplishment of both functions eg., the water expulsion, and the introduction of the liquid antifreeze, which may usually reflect itself on increased profit and lower cost to the customer of the tradesman employing the present tool.

It is also clear that the conduit tool of the present invention, being readily made from existing parts, is relatively inexpensive to make duplicate copies or for replacement of a damaged part of a unit fabricated as described herein.

While I have searched many sources, no structure like the disclosed herein has been found anywhere in the literature or in multipurpose stores or building supply houses and the like.

While I have disclosed several embodiments of the present invention, and have described and illustrated the invention, as set forth in the drawings, it would be appreciated that this disclosure is for purposes of illustration only. And that one reasonably skilled in the art may make many obvious substitutions of material or contour configuration as clearly calculated to accomplish the same purposes without departing from the spirit and scope of the present invention, unless to do so would be violative of the scope of the appendent claims.

I claim:

1. A portable tool of dual functionality, both as a relatively air tight conduit for air and a relatively liquid tight reservoir for liquid anti-freeze, said tool comprising, an elongate tubular member having an upper inlet end, a lower outlet end and a side opening for introducing anti-freeze liquid, said side opening being removably hand-closured and located near the upper end of said tubular member, first flexible conduit means constructed and arranged for fluidly hand-connecting said upper inlet end of said portable tool to a source of pressurized air, and including in-line on/off valve means, and second flexible conduit means for fluidly connecting said lower outlet end of said portable tool to the plumbing system of a house, RV, boat or the like, whereby liquid, usually water, can be pressure removed from the plumbing system responsive to actuation of said source of pressurized air, together with appropriate openings and closings of the various valve faucet outlets in the plumbing system and, thereafter liquid antifreeze can be introduced through said side opening into said side elongated tubular member, essentially emptied of liquid, usually water, and, thereafter forced into the plumbing system by actuation of said source of pressurized air, to thereby protect the plumbing system from damage by exposure to temperatures below freezing.

2. The invention, as claimed in claim 1, wherein said elongated tubular member consists of a linear section of tubular plastic pipe.

3. The invention, as claimed in claim 1, wherein said elongated tubular member is composed of two axially and threadingly connected sections of plastic pipe; the upper most of which two sections includes an integral formed, closured side opening defining an opening leading to the interior of said two sections of plastic pipe and a threaded, closure cap for said opening, said opening serving as an inlet for liquid antifreeze.

4. The invention as claimed in claim 3 wherein the upper most of said two sections includes an integrally formed, upwardly angled and threaded terminus, said upwardly angled feature permitting easy introduction of liquid antifreeze to said tubular member.

5. The invention as claimed in claim 4 wherein the two sections shall be connected tubular members of approximately three and one-half inch diameter PVC pipe, measuring in the neighborhood of ten inches in length.

6. The invention, as claimed in claim 1, wherein the plug, for the upper side opening, is a preset pressure relief cap.

* * * * *